US009677259B2

(12) United States Patent
Shucofsky

(10) Patent No.: US 9,677,259 B2
(45) Date of Patent: Jun. 13, 2017

(54) DUAL VALVE WATER DISCHARGE SYSTEM

(71) Applicant: John Russell Shucofsky, Cleveland, OH (US)

(72) Inventor: John Russell Shucofsky, Cleveland, OH (US)

( * ) Notice: Subject to any disclaimer, the term of this patent is extended or adjusted under 35 U.S.C. 154(b) by 0 days.

(21) Appl. No.: 14/704,780

(22) Filed: May 5, 2015

(65) Prior Publication Data

US 2015/0322655 A1 Nov. 12, 2015

Related U.S. Application Data

(60) Provisional application No. 61/989,348, filed on May 6, 2014.

(51) Int. Cl.

| | |
|---|---|
| ***E03D 1/14*** | (2006.01) |
| ***E03D 1/30*** | (2006.01) |
| ***E03D 1/34*** | (2006.01) |
| ***E03D 5/092*** | (2006.01) |
| ***E03D 5/094*** | (2006.01) |

(52) U.S. Cl.

CPC ..... *E03D 1/308* (2013.01); *E03D 1/142* (2013.01); *E03D 1/145* (2013.01); *E03D 1/34* (2013.01); *E03D 5/092* (2013.01); *E03D 5/094* (2013.01)

(58) Field of Classification Search

CPC E03D 1/145; E03D 1/142; E03D 1/34; E03D 1/306; E03D 1/308

USPC ..... 4/415, 324–327, 355, 356, 378, 379

See application file for complete search history.

(56) References Cited

U.S. PATENT DOCUMENTS 1,605,938 A * 11/1926 Haas ..... E03D 1/30 4/412
2,046,888 A * 7/1936 Watt ..... E03D 5/094 4/412
2,412,738 A * 12/1946 Martin ..... E03D 5/094 4/412
2,767,406 A * 10/1956 Bennett ..... E03D 1/306 4/392
3,302,217 A * 2/1967 Schrock ..... E03D 1/308 4/386
3,795,016 A * 3/1974 Eastman ..... E03D 1/34 4/326
3,964,109 A * 6/1976 Stree ..... E03D 1/144 4/327
4,160,294 A * 7/1979 Crumby ..... E03D 1/144 4/324
4,937,894 A * 7/1990 Hill, Jr. ..... E03D 1/142 4/324

(Continued)

*Primary Examiner* — Erin Deery

(57) ABSTRACT

A dual valve water discharge system is a system through which the user is able to select the volume of water used when flushing liquid waste and/or solid waste. The system features a drain flap with a flow through hole that restricts the flow of water entering a tank drain. The drain flap is covered by a flow rate control flap that is lifted to expose the flow through hole. The drain flap may be lifted as well, in turn lifting the flow rate control flap and allowing unrestricted flow into the tank drain. The flush volume is selected by lifting a flush handle upward or pressing the flush handle downward. The flush handle is connected to a flush lever which is in turn connected to a first cord and a second cord that are able to lift the drain flap and the flow rate control flap.

8 Claims, 9 Drawing Sheets

(56) References Cited

U.S. PATENT DOCUMENTS

| | | | | | |
|---|---|---|---|---|---|
| 5,414,877 | A * | 5/1995 | Tsai | E03D 1/308 | 4/325 |
| 5,483,706 | A * | 1/1996 | Tsai | E03D 1/144 | 4/325 |
| 5,673,441 | A * | 10/1997 | Wang | E03D 1/308 | 4/324 |
| 6,467,100 | B2 * | 10/2002 | Leach | E03D 1/142 | 4/325 |
| 6,829,787 | B1 * | 12/2004 | Pipenburg | E03D 1/142 | 4/393 |
| 7,591,027 | B2 * | 9/2009 | Scruggs | E03D 1/306 | 4/327 |

* cited by examiner

DUAL VALVE WATER DISCHARGE SYSTEM

The current application claims a priority to the U.S. Provisional Patent application Ser. No. 61/989,348 filed on May 6, 2014.

FIELD OF THE INVENTION

The present invention relates generally to a device for selecting the flow rate of a toilet flush valve assembly. More specifically, the present invention is a dual valve water discharge system that allows the user to select the desired flush volume based on the water requirements to flush solid waste and/or liquid waste.

BACKGROUND OF THE INVENTION

When a conventional flush toilet is flushed, water within the toilet tank flows into the water and waste within the toilet bowl. The contents of the toilet bowl are then siphoned through the toilet drain and the toilet tank and the toilet bowl are refilled with water. Flush toilets account for a significant portion of personal water usage due to the large amount of water that is used to flush the toilets and move the waste-water into the sewage system. Conventional flush toilets utilize the same water volume to dispose of waste, regardless of the composition of the waste. The dual flush toilet is a toilet system that allows the user to select the water volume of each flush based on the type of human waste that must be flushed. A half flush is used for liquid waste while a full flush is used for solid waste as flushing liquid waste generally does not require as much water as flushing solid waste.

The present invention is a dual valve water discharge system that allows the user to select the desired flush volume when flushing a flush toilet. The present invention is mounted within the toilet tank over the flush valve. The flow volume of the toilet is selected by turning a handle in one of two directions. Two flaps are mounted over the flush valve, with each flap corresponding to a desired water volume for flushing. The handle is connected to the two flaps via a chain that is able to lift the selected flap, allowing the corresponding water volume to be used during flushing. The chain is guided via a grooved guide that is mounted into the toilet overflow pipe.

DETAIL DESCRIPTIONS OF THE INVENTION

Figure 1:
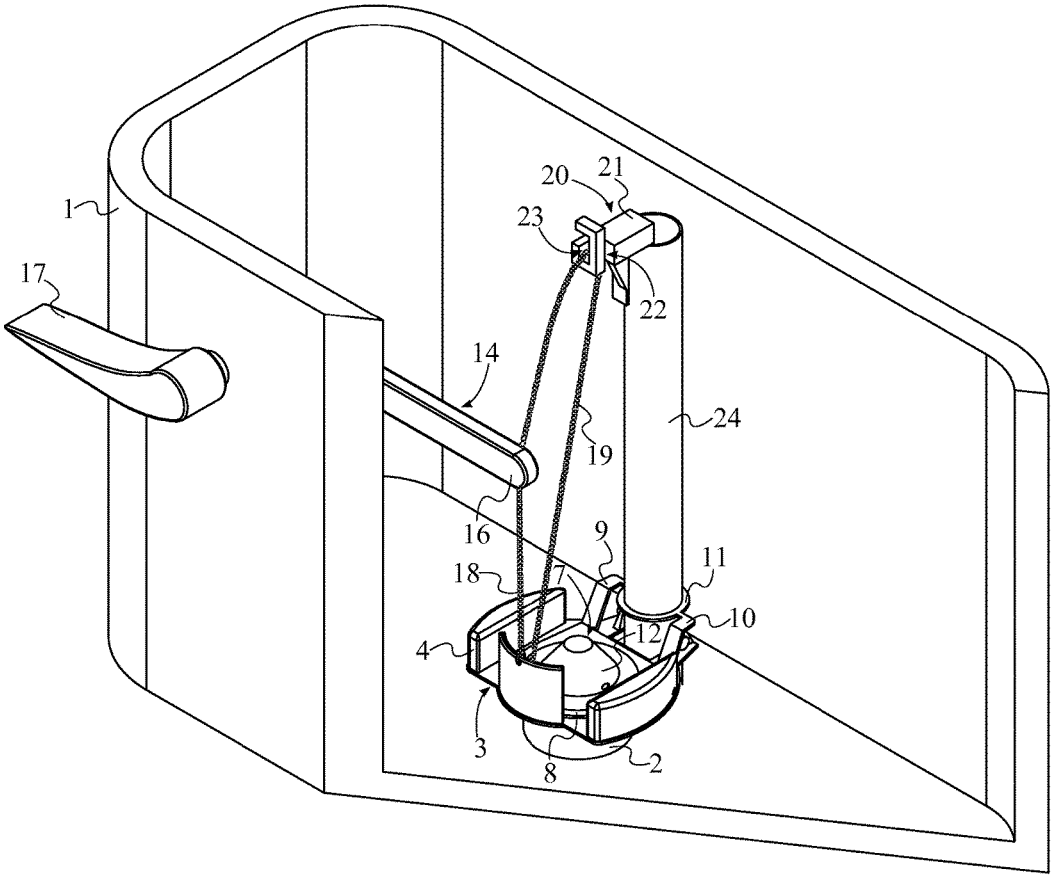
FIG. 1 is a perspective view of a toilet tank with a portion of the toilet tank cut out to show the present invention.

All illustrations of the drawings are for the purpose of describing selected versions of the present invention and are not intended to limit the scope of the present invention.

The present invention is a dual valve water discharge system that allows the user to select the desired flush volume of a flush toilet for flushing solid waste and/or liquid waste. The present invention is shown in FIGS. 1-5 and comprises a toilet tank 1, a tank drain 2, a drain flap 3, a flow through hole 6, a flow rate control flap 7, a flush lever 14, a flush handle 17, a first cord 18, a second cord 19, and a pulley guide 20.

With reference to FIG. 1, the toilet tank 1 is a tank that holds water that is used to fill the toilet bowl during flushing. The tank drain 2 is the pipe through which the water exits the toilet tank 1 during flushing.

Figure 3:
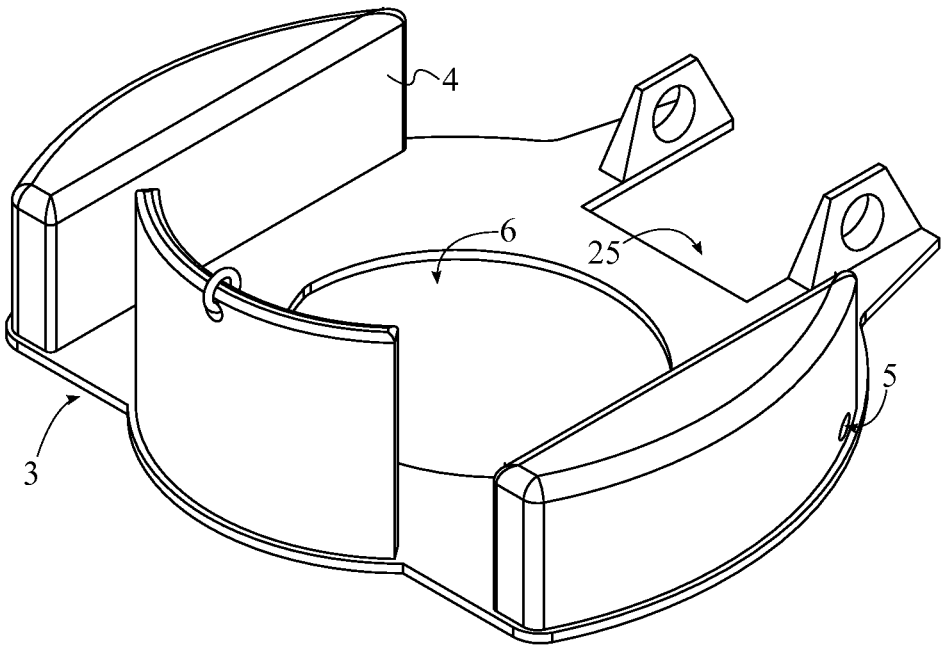
FIG. 3 is a perspective view of the drain flap.

The drain flap 3 is the flap that covers the tank drain 2 as shown in FIG. 1 and FIG. 3. The flow through hole 6 traverses through the drain flap 3 to allow water within the toilet tank 1 to pass through the drain flap 3 and into the tank drain 2. In the preferred embodiment of the present invention, the flow through hole 6 is smaller than the opening of the tank drain 2 in order to constrict the flow of water through the tank drain 2. This causes a lower volume of water to be used when the toilet is flushed. The drain flap 3 is hingedly mounted within the toilet tank 1, adjacent to the tank drain 2. As such, the drain flap 3 may be lifted to completely uncover the tank drain 2 when the user wishes to utilize a high volume of water when flushing. In the preferred embodiment of the present invention, the drain flap 3 is composed of a resilient material such as, but not limited to, rubber and silicone.

Figure 4:
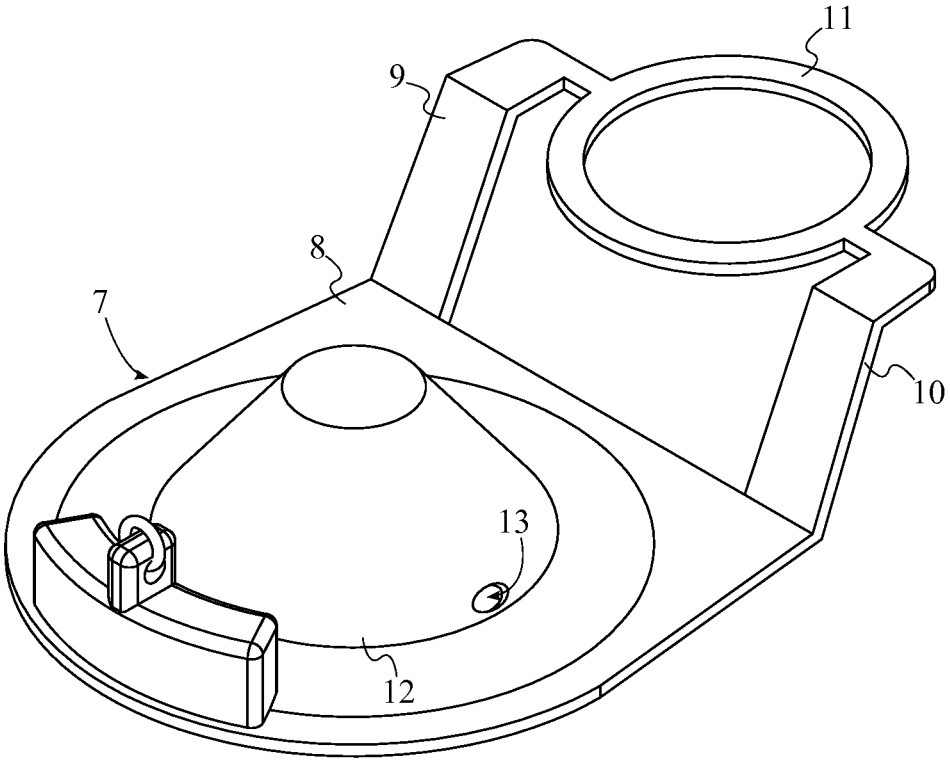
FIG. 4 is a perspective view of the flow rate control flap.

The flow rate control flap 7 is shown in FIG. 1 and FIG. 4 and is used to regulate the volume of water that is used during a flush. The flow rate control flap 7 is hingedly mounted within the toilet tank 1, adjacent to the flow through hole 6. This allows the flow rate control flap 7 to cover the flow through hole 6 and be lifted in order to uncover the flow through hole 6 when the user wishes to utilize a low volume of water when flushing. When the drain flap 3 is lifted for a high volume flush, the flow rate control flap 7 is lifted as well. Similar to the drain flap 3, in the preferred embodiment of the present invention, the flow rate control flap 7 is composed of a resilient material such as, but not limited to, rubber and silicone.

Figure 2:
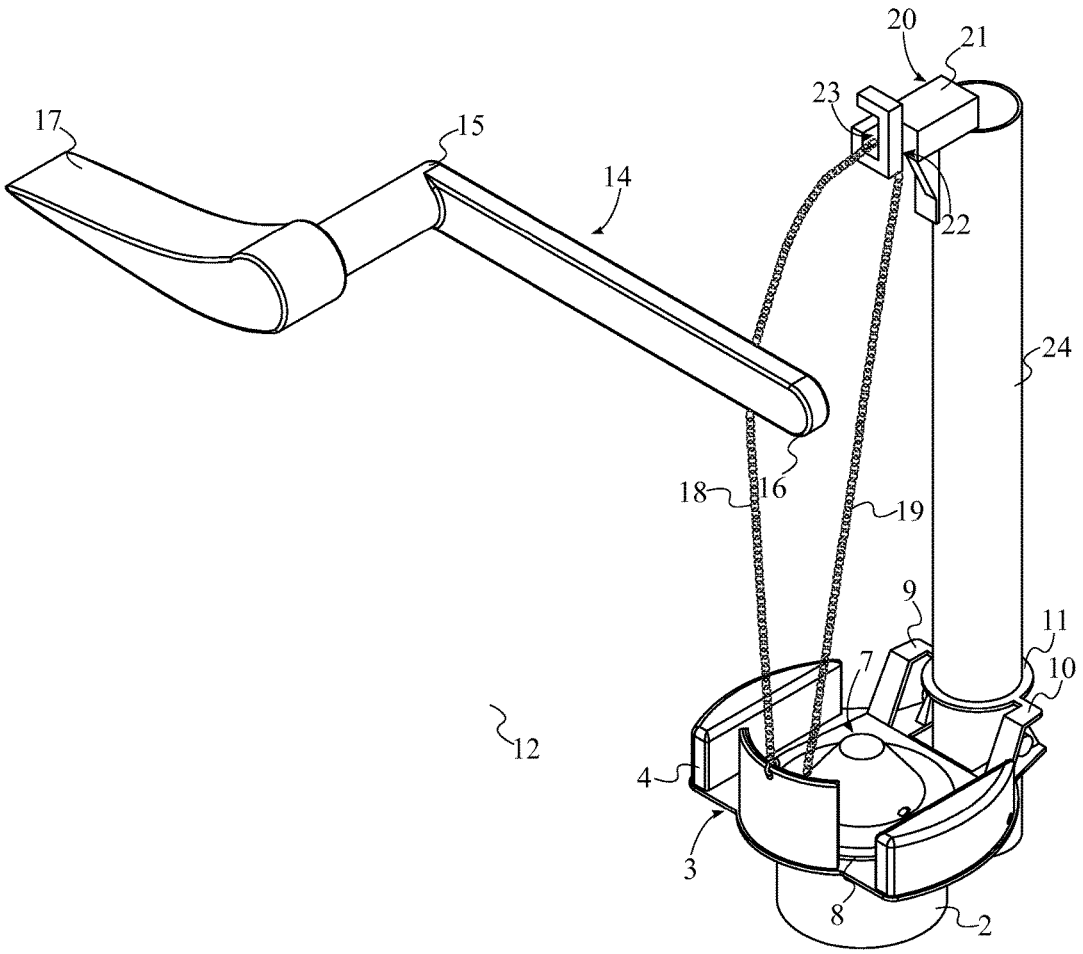
FIG. 2 is a perspective view of the present invention.

As shown in FIG. 1 and FIG. 2, the flush handle 17 is the handle that allows the user to select a high volume of water or a low volume of water for a flush. The flush handle 17 is externally positioned to the toilet tank 1 for convenient user access when flushing. The flush lever 14 is the lever that transfers the motion of the flush handle 17 in order to lift the drain flap 3 and/or the flow rate control flap 7. This motion is transferred to the first cord 18 and the second cord 19 that in turn lift the drain flap 3 and/or the flow rate control flap 7. The flush lever 14 comprises a first end 15 and a second end 16 that are opposing ends of the flush lever 14. The first end 15 is rotatably mounted within the toilet tank 1 and additionally, the flush handle 17 is axially connected to the first end 15. This allows the flush lever 14 to rotate the first end 15 when the flush lever 14 is lifted upward or pressed downward. The second end 16 is tethered to the drain flap 3 by the first cord 18 while the second end 16 is tethered to the flow rate control flap 7 by the second cord 19. This allows the motion from the flush handle 17 and the flush lever 14 to be transferred to the first cord 18 or the second cord 19 when lifting the drain flap 3 or the flow rate control flap 7, respectively. In the preferred embodiment of the present invention, the first cord 18 and the second cord 19 are preferably composed of a corrosion-resistant material.

Figure 5:
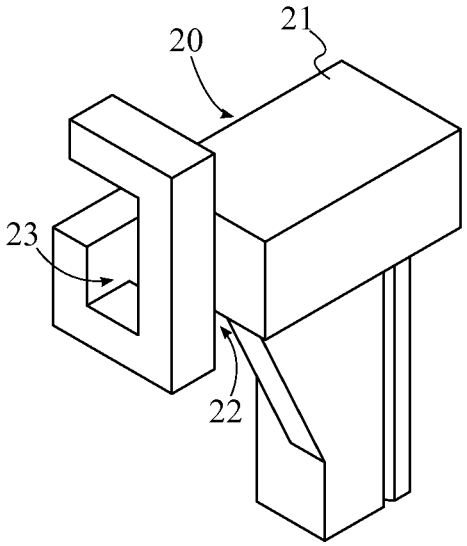
FIG. 5 is a perspective view of the pulley guide.

The pulley guide 20 is shown in FIG. 5 and is mounted within the toilet tank 1 offset from the flow rate control flap 7 as shown in FIG. 1 and FIG. 2. The pulley guide 20 is able to hold the second cord 19 while the second cord 19 is slidably engaged about the pulley guide 20. The second cord 19 is able to slide about the pulley guide 20 when the flush lever 14 is lifted upward or pressed downward in order to lift the drain flap 3 or the flow rate control flap 7 or the drain flap 3, respectively.

With reference to FIG. 1, FIG. 2, and FIG. 4, the present invention further comprises an overflow tube 24. The overflow tube 24 is a tube within the toilet tank 1 that prevents the toilet tank 1 from overflowing when the toilet tank 1 is being refilled. The overflow tube 24 is additionally the tube to which the drain flap 3, the flow rate control flap 7, and the pulley guide 20 are mounted. The overflow tube 24 is mounted within the toilet tank 1, adjacent to the tank drain 2, placing the drain flap 3, the flow rate control flap 7, and the pulley guide 20 into close proximity of the tank drain 2. Additionally, the overflow tube 24 is oriented parallel to the tank drain 2, allowing the drain flap 3 and the flow rate control flap 7 to completely cover the tank drain 2 when mounted to the overflow tube 24. In some embodiments of the present invention, mounting the drain flap 3, the flow rate control flap 7, and the pulley guide 20 to the overflow tube 24 is more efficient if the overflow tube 24 is positioned in this manner. In these embodiments, the flow rate control flap 7 comprises a control plate 8, a first flexible arm 9, a second flexible arm 10, and a connecting ring 11. The control plate 8 is the portion of the flow rate control flap 7 that is placed over and covers the flow through hole 6. The first flexible arm 9 and the second flexible arm 10 are connected adjacent to the control plate 8 and additionally are laterally connected to the connecting ring 11, opposite to the control plate 8. This allows the first flexible arm 9, the second flexible arm 10, and the connecting ring 11 to be utilized as a hinged mount to the overflow tube 24. The first flexible arm 9 and the second flexible arm 10 are oriented parallel to each other in order to facilitate uniform bending of the first flexible arm 9 and the second flexible arm 10 when the flow rate control flap 7 is being lifted. The connecting ring 11 allows the flow rate control flap 7 to be mounted to the overflow tube 24 and is mounted about the overflow tube 24, preventing the connecting ring 11 from separating from the overflow tube 24.

Referring to FIGS. 1-3, the present invention further comprises a clearance slot 25. The clearance slot 25 allows the drain flap 3 to rotate when being lifted. The drain flap 3 is hingedly connected to the overflow tube 24 and is able to rotate, causing the flow rate control flap 7 to lift as well. The overflow tube 24 is positioned into the clearance slot 25, allowing the drain flap 3 to be mounted about the overflow tube 24. The clearance slot 25 traverses into the drain flap 3, opposite to the flow through hole 6. Additionally, the clearance slot 25 traverses normal to and through the drain flap 3. As such, when the drain flap 3 is lifted, the flow rate control flap 7 is lifted as well and the tank drain 2 is uncovered. In the preferred embodiment of the present invention, the drain flap 3 may be secured to the overflow tube 24 via fasteners.

With reference to FIG. 3, the drain flap 3 comprises an at least one drain ballast chamber 4 and a drain buoyancy-adjustment hole 5. The at least one drain ballast chamber 4 is used to increase or decrease the buoyancy of the drain flap 3. The drain buoyancy-adjustment hole 5 is used to allow air into or out of the at least one drain ballast chamber 4. The drain buoyancy-adjustment hole 5 traverses into the at least one drain ballast chamber 4 and, as such, the user is able to open the drain buoyancy-adjustment hole 5 to allow air into the at least one drain ballast chamber 4 when increasing the buoyancy. Conversely, the user is able to squeeze the at least one drain ballast chamber 4 to force air out through the drain buoyancy-adjustment hole 5 when decreasing the buoyancy. The at least one drain ballast chamber 4 is connected onto the drain flap 3, adjacent to the flow through hole 6. As such, allowing air into or forcing air out of the at least one drain ballast chamber 4 causes the buoyancy of the drain flap 3 to increase or decrease, respectively. Because the at least one drain ballast chamber 4 is positioned next to the flow through hole 6, the at least one drain ballast chamber 4 is able to control the elevation of the drain flap 3 within the water.

As seen in FIG. 4, the flow rate control flap 7 further comprises an at least one control ballast chamber 12 and a control buoyancy-adjustment hole 13. The at least one control ballast chamber 12 and the control buoyancy-adjustment hole 13 function similar to the at least one drain ballast chamber 4 and the drain buoyancy-adjustment hole 5. The control buoyancy-adjustment hole 13 traverses into the at least one control ballast chamber 12 and as such, air is able to enter into or exit out of the at least one control ballast chamber 12. The at least one control ballast chamber 12 is connected onto the flow rate control flap 7, adjacent to the flow through hole 6. This allows the user to adjust the buoyancy of the flow rate control flap 7 through the at least one control ballast chamber 12. The position of the at least one control ballast chamber 12 allows the at least one control ballast chamber 12 to control the elevation of the control flap 7 within the water.

With reference to FIG. 1, FIG. 2, and FIG. 5, the pulley guide 20 comprises a stem 21, a groove 22, and a hole 23. The pulley guide 20 is able to regulate the tension direction of the second cord 19 when the flush handle 17 is lifted upward or pressed downward in order to lift the flow rate control flap 7 or the drain flap 3. The stem 21 is the body portion of the pulley guide 20 that serves to hold the second cord 19 when the toilet is being flushed. The groove 22 and the hole 23 serve to secure the second cord 19 to the pulley guide 20 and prevent the second cord 19 from separating from the pulley guide 20. The stem 21 and the tank drain 2 are positioned offset from each other along the overflow tube 24. Additionally, the stem 21 is removably and adjacently attached to the overflow tube 24. As such, the stem 21 provides a mounting point for the second cord 19 that is offset from the flush lever 14 as well as the drain flap 3 and the flow rate control flap 7. The hole 23 traverses through the stem 21, parallel to the overflow tube 24, while the groove 22 traverses into the stem 21, opposite the overflow tube 24. Additionally, the hole 23 is intersected by the groove 22. This allows the second cord 19 to be routed into and over the groove 22 and the hole 23 in order to prevent the second cord 19 from separating from the stem 21 and allow the second cord 19 to be tensioned in the appropriate direction based on the direction in which the flush handle 17 is moved.

Figure 6:
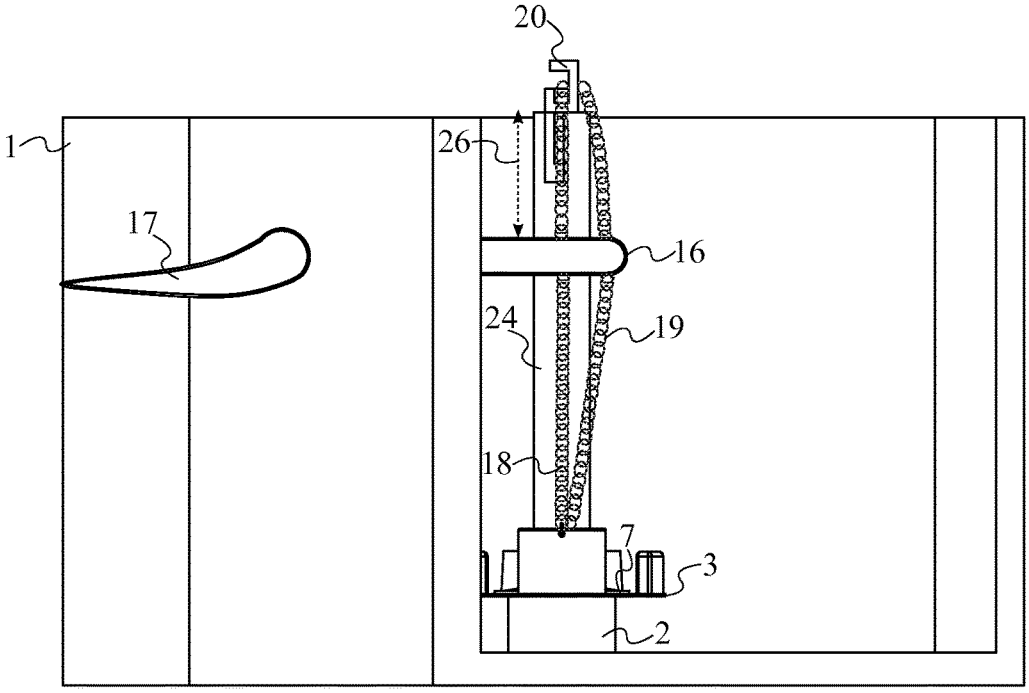
FIG. 6 is a front view of the present invention in a neutral configuration.

The drain flap 3, the flow rate control flap 7, and the pulley guide 20 are shown in a neutral configuration in FIG. 6. In the neutral configuration, the second end 16 is offset from the pulley guide 20 by an equilibrium distance 26. When the second end 16 is offset from the pulley guide 20 by the equilibrium distance 26, the flush handle 17 is neither lifted upward nor pressed downward and the toilet is ready for flushing. The drain flap 3 is pressed against the tank drain 2 and the flow rate control flap 7 is pressed against the drain flap 3, covering the tank drain 2 by forming a seal and preventing water within the toilet tank 1 from exiting through the tank drain 2.

Figure 7:
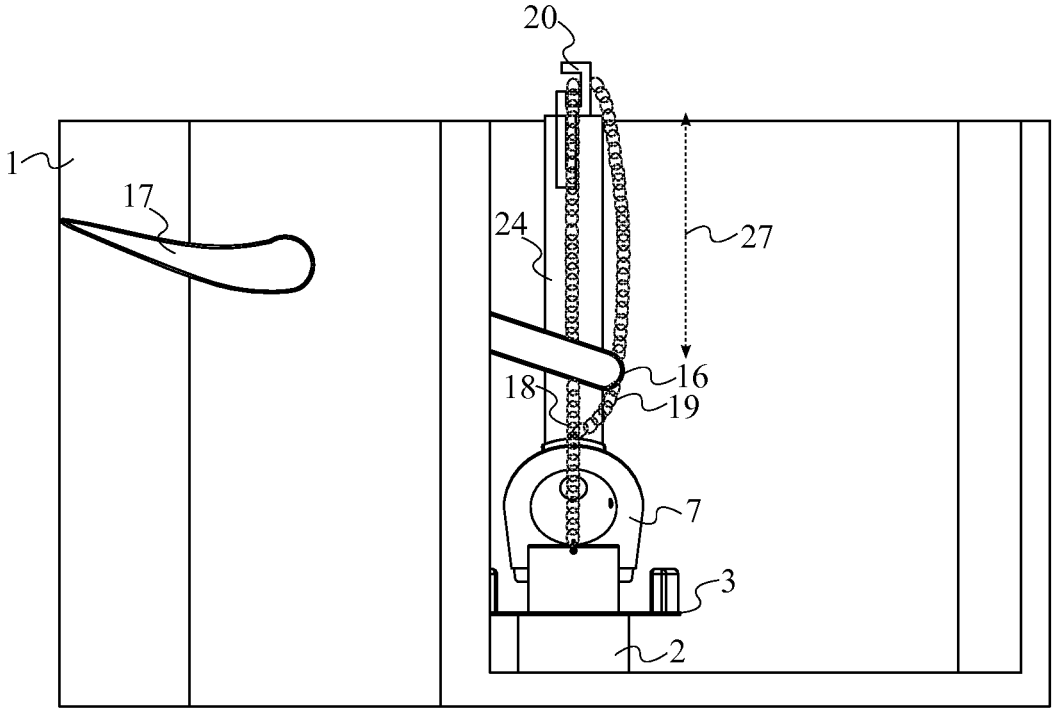
FIG. 7 is a front view of the present invention in a low flush volume configuration.

The drain flap 3, the flow rate control flap 7, the flush lever 14, and the pulley guide 20 are shown in a low flush volume configuration in FIG. 7. The low flush volume configuration is appropriate for flushing liquid waste as the water volume requirement for flushing liquid waste is much lower than the requirement for flushing solid waste. The second end 16 is offset from the pulley guide 20 by a low flow distance 27. The low flow distance 27 is greater than the equilibrium distance 26 and is the distance that separates the second end 16 from the pulley guide 20 when the flush handle 17 is lifted upward. When the flush handle 17 is lifted upward, the drain flap 3 remains pressed against the tank drain 2. However, the flow rate control flap 7 is angularly offset from the drain flap 3, exposing the flow through hole 6. Lifting the flush handle 17 upward causes the second cord 19 to pull and lift the flow rate control flap 7 due to the first flexible arm 9 and the second flexible arm 10. Water within the toilet tank 1 is allowed to exit the toilet tank 1 through the flow through hole 6 and the tank drain 2. Because the flow through hole 6 is smaller than the opening of the tank drain 2, a low volume of water is used during the flush.

Figure 8:
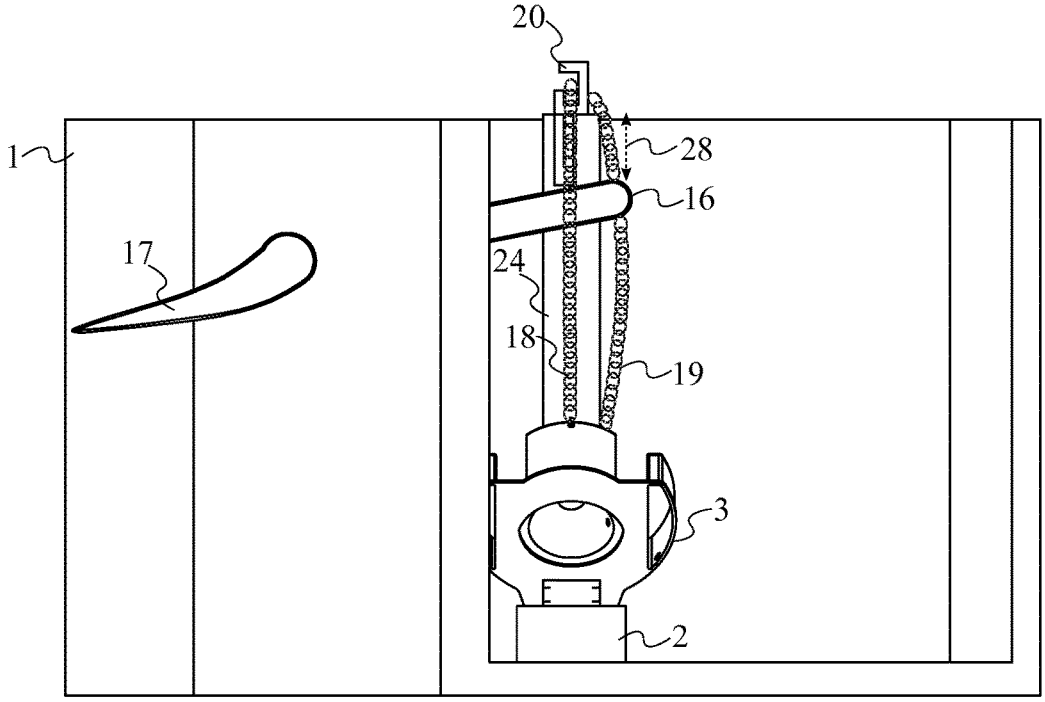
FIG. 8 is a front view of the present invention in a high flush volume configuration.
Figure 9:
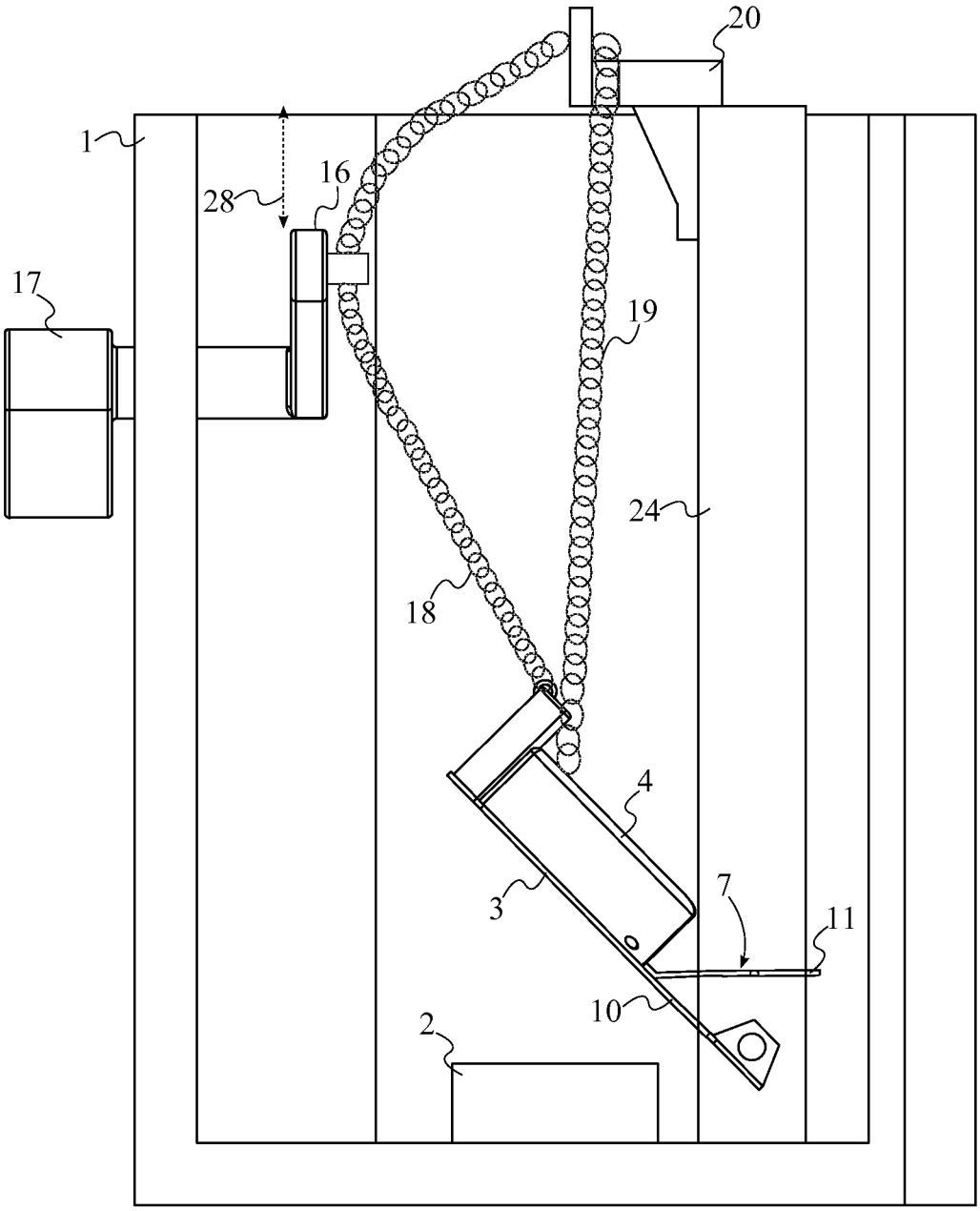
FIG. 9 is a right side view of the present invention in a high flush volume configuration.

The drain flap 3, the flow rate control flap 7, and the pulley guide 20 are shown in a high flush volume configuration in FIG. 8 and FIG. 9. The high flush volume configuration is appropriate for flushing solid waste. The second end 16 is offset from the pulley guide 20 by a high flow distance 28. The high flow distance 28 is shorter than the equilibrium distance 26 and is the distance that separates the second end 16 from the pulley guide 20 when the flush handle 17 is pressed downward. When the flush handle 17 is pressed downward, the drain flap 3 and the flow rate control flap 7 are angularly offset from the tank drain 2. This fully uncovers the tank drain 2 and allows water within the toilet tank 1 to freely exit the toilet tank 1 through the tank drain 2. Pressing the flush handle 17 downward causes the first cord 18 to pull and lift the drain flap 3, causing the flow rate control flap 7 to be lifted as well.

Although the present invention has been explained in relation to its preferred embodiment, it is understood that many other possible modifications and variations can be made without departing from the spirit and scope of the present invention as hereinafter claimed.

What is claimed is:

1. A dual valve water discharge system comprising:
- a toilet tank;
- a tank drain;
- a drain flap;
- a flow through hole;
- a flow rate control flap;
- a flush lever;
- a flush handle;
- a first cord;
- a second cord;
- a pulley guide;
- the flush lever comprising a first end and a second end;
- the drain flap being hingedly mounted within the toilet tank, adjacent to the tank drain;
- the flow through hole traversing through the drain flap;
- the flow rate control flap being hingedly mounted within the toilet tank, with respect to the flow through hole;
- the first end being rotatably mounted within the toilet tank;
- the flush handle being axially connected to the first end;
- the flush handle being externally positioned to the toilet tank;
- the pulley guide being mounted within the toilet tank offset from the flow rate control flap;
- the second end being tethered to the drain flap by the first cord;
- the second end being tethered to the flow rate control flap by the second cord;
- the second cord being slidably engaged about the pulley guide;
- an overflow tube;
- the overflow tube being mounted within the toilet tank, adjacent to the tank drain;
- the overflow tube being oriented parallel to the tank drain;
- the pulley guide comprising a stem, a groove, and a hole;
- the stem being removably and adjacently attached to the overflow tube such that the overflow tube is positioned in between the stem and the tank drain
- the hole traversing into the stem;
- the groove traversing into the stem;
- the hole being intersected by the groove; and the second cord being slidably engaged in the groove and the hole.

2. The dual valve water discharge system as claimed in claim 1 further comprising:
- the flow rate control flap comprising a control plate, a first flexible arm, a second flexible arm, and a connecting ring;
- the first flexible arm and the second flexible arm being connected to the control plate;
- the first flexible arm and the second flexible arm being laterally connected to the connecting ring;
- the first flexible arm and the second flexible arm being positioned in between the control plate and the connecting ring;
- the first flexible arm and the second flexible arm being oriented parallel to each other; and
- the connecting ring being mounted about the overflow tube.

3. The dual valve water discharge system as claimed in claim 1 further comprising:
- a clearance slot;
- the clearance slot traversing into the drain flap;
- the clearance slot being formed adjacent to the flow through hole;
- the clearance slot traversing through the drain flap;
- the overflow tube being positioned into the clearance slot; and
- the drain flap being hingedly connected to the overflow tube.

4. The dual valve water discharge system as claimed in claim 1 further comprising:
- the drain flap comprising at least one drain ballast chamber and a drain buoyancy-adjustment hole;
- the drain buoyancy-adjustment hole traversing into the at least one drain ballast chamber; and
- the at least one drain ballast chamber being connected to the drain flap, adjacent to the flow through hole.

5. The dual valve water discharge system as claimed in claim 1 further comprising:
- the flow rate control flap comprising at least one control ballast chamber and a control buoyancy-adjustment hole;
- the control buoyancy-adjustment hole traversing into the at least one control ballast chamber; and
- the at least one control ballast chamber being connected to the flow rate control flap.

6. The dual valve water discharge system as claimed in claim 1, further comprising:
- wherein when the drain flap, flow rate control flap, and the pulley guide are in a neutral configuration;

the second end is offset from the pulley guide by an equilibrium distance;

the drain flap pressing is pressed against the tank drain; and the flow rate control flap is pressed against the drain flap.

7. The dual valve water discharge system as claimed in claim 1 further comprising:

wherein when the drain flap, the flow rate control flap, and the pulley guide are in a low flush volume configuration;

the second end is offset from the pulley guide by a low flow distance;

wherein the low flow distance is greater than an equilibrium distance between the second end and the pulley guide;

the drain flap is pressed against the tank drain; and the flow rate control flap is angularly offset from the drain flap.

8. The dual valve water discharge system as claimed in claim 1 further comprising:

wherein when the drain flap, the flow rate control flap, and the pulley guide are in a high flush volume configuration;

the second end is offset from the pulley guide by a high flow distance;

the high flow distance is shorter than an equilibrium distance between the second and the pulley guide; and the drain flap and the flow rate control flap are angularly offset from the tank drain.

* * * * *